US008063548B2

(12) United States Patent
Bishop

(10) Patent No.: US 8,063,548 B2
(45) Date of Patent: Nov. 22, 2011

(54) FLEXIBLE SPARK PLUG

(76) Inventor: Bobby Glen Bishop, Douglasville, GA (US)

( * ) Notice: Subject to any disclaimer, the term of this patent is extended or adjusted under 35 U.S.C. 154(b) by 30 days.

(21) Appl. No.: 12/660,376

(22) Filed: Feb. 25, 2010

(65) Prior Publication Data

US 2010/0225222 A1 Sep. 9, 2010

Related U.S. Application Data

(60) Provisional application No. 61/209,048, filed on Mar. 3, 2009.

(51) Int. Cl.
*H01T 13/20* (2006.01)

(52) U.S. Cl. ..... 313/141; 313/128; 313/135; 313/143

(58) Field of Classification Search ..... None
See application file for complete search history.

(56) References Cited

U.S. PATENT DOCUMENTS

| | | | | |
|---|---|---|---|---|
| 2,351,564 | A * | 6/1944 | Wall | 313/137 |
| 2,458,121 | A * | 1/1949 | Waldron | 439/126 |
| 2,522,169 | A * | 9/1950 | Frei | 174/91 |
| 2,646,782 | A * | 7/1953 | Fisher | 313/120 |
| 3,693,607 | A | 9/1972 | Pasbrig | |
| 3,918,789 | A | 11/1975 | Davis | |
| 4,413,870 | A | 11/1983 | Labutski, III | |
| 5,813,872 | A | 9/1998 | Evans et al. | |
| 6,597,088 | B1 * | 7/2003 | Glaser et al. | 313/118 |
| 2003/0098636 | A1 | 5/2003 | Quan et al. | |

* cited by examiner

*Primary Examiner* — Ashok Patel
(74) *Attorney, Agent, or Firm* — Jerome E Sacks

(57) ABSTRACT

A spark plug designed for fitting in tight spaces of an engine compartment is disclosed. The spark plug has a conductive terminal attached to one end of a flexible central electrode and has a ceramic insulator partially encasing the flexible central electrode. The part of the flexible central electrode between the ceramic insulator and the conductive terminal is encased in a flexible insulator. The flexible part of the central electrode may be bent away from the axis of the ceramic insulator accommodating both installation and servicing of the spark plug in tight spaces.

5 Claims, 8 Drawing Sheets

FLEXIBLE SPARK PLUG

CROSS-REFERENCE TO RELATED APPLICATIONS

This application claims the benefit of the U.S. Provisional Patent Application No. 61/209,048 filed Mar. 3, 2009 by the present inventor. This provisional patent application is incorporated herein by reference.

TECHNICAL FIELD

The present invention relates to spark plugs, more particularly to spark plugs that are used in small cramped spaces.

BACKGROUND OF THE DISCLOSURE

A spark plug for an internal combustion engine generally is comprised of a rod-like central electrode, a hollow cylindrical ceramic insulator encasing the central electrode, a conductive terminal attached to the central electrode at the spark plug terminal end, a hollow cylindrical metal shell partially encasing the ceramic insulator having threads for mating the spark plug with the engine block, a hexagonal nut for gripping the plug with a wrench, and an L-shaped ground electrode attached to the ignition end of the metal shell.

When the spark plug is installed in the engine compartment, the threads are mated to the engine block with the ignition end accessing the combustion chamber. The ignition coil is connected to the terminal end of the spark plug via ignition wires going from the ignition coil to the spark plug terminal end. The ignition coil wire is attached to the spark plug terminal with a clip.

In some cases, space around the spark plug is severely limited. Therefore, installation, removal and servicing of the spark plug can be difficult. There are several ways of handling this problem. Sometimes, other components in the engine compartment need to be removed to give access to the spark plug. Another solution uses a modified clip design that limits the space required for the plug stem plus clip. Still other methods use special spark plug wrenches that permit working in a limited space. Another approach is to use special spark plug designs that shorten the length of the spark plug between the spark plug hexagonal nut and the terminal end. All these solutions have utility in some situations. However none of these solutions are totally satisfactory.

SUMMARY OF THE DISCLOSURE

The flexible spark plug embodiments of the present invention presented herein solve the problem of accommodating a spark plug in an engine compartment where access to the spark plug is limited. The flexible spark plug employs a ceramic insulator with a shortened length above the spark plug's hexagonal nut at the terminal end of the plug as compared to a standard spark plug. It uses a flexible conductive wire instead of a central electrode rod. The flexible conductive wire has the same conductivity and diameter as a central electrode rod, and is covered by an insulating flexible covering. When installing an embodiment, the flexible electrode may be bent away from the axis of the ceramic insulator. This novel design allows the spark plug to be installed in the engine block in a way that provides less vertical clearance than required for a standard plug, and allows the spark plug terminal to be attached to the ignition wire clip in a location that is easier to access.

DETAILED DESCRIPTION

In the following, the terms top, upper, bottom and lower are interpreted as viewed in the figures. A spark plug has a terminal end, where a clip from in ignition wire is attached, and an ignition end where a spark is generated.

Figure 1A:
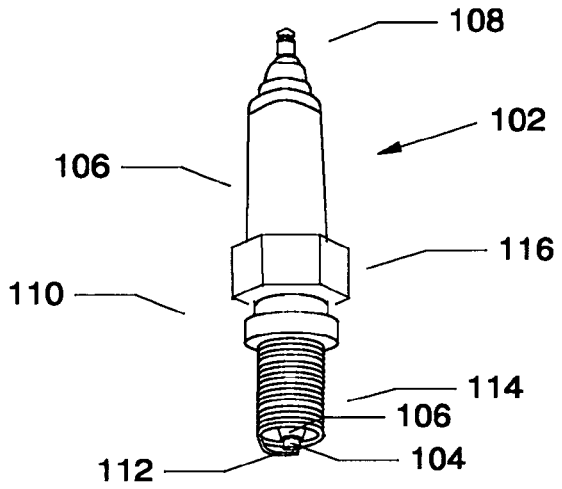
FIG. 1A Prior Art
FIG. 1A illustrates a perspective view of a first prior art spark plug.
Figure 1B:
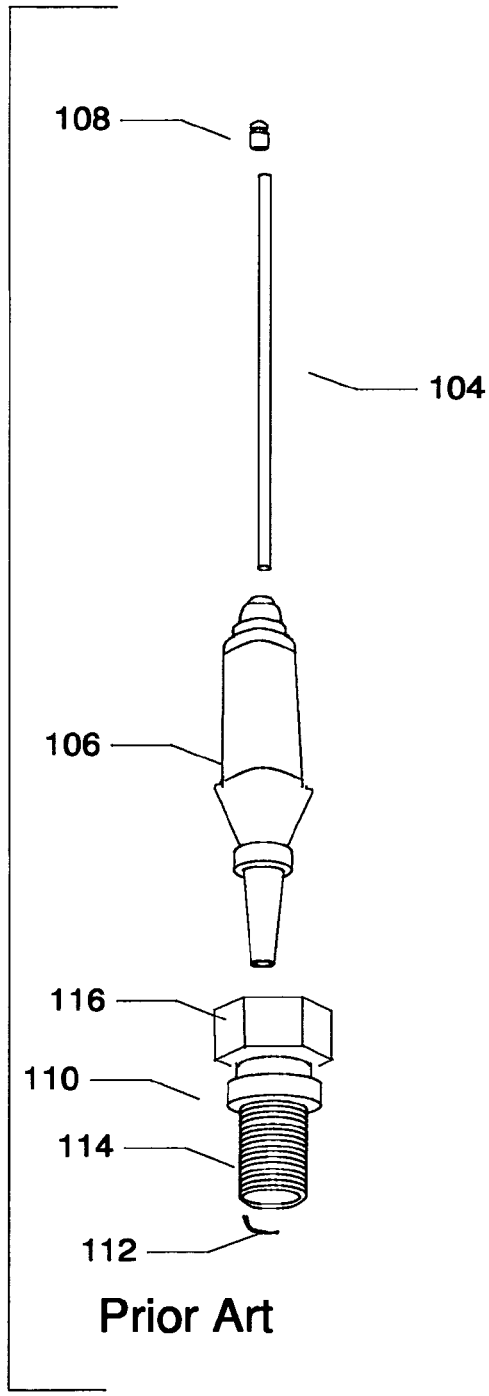
FIG. 1B Prior Art
FIG. 1B is an exploded view of the first prior art spark plug.
Figure 1C:
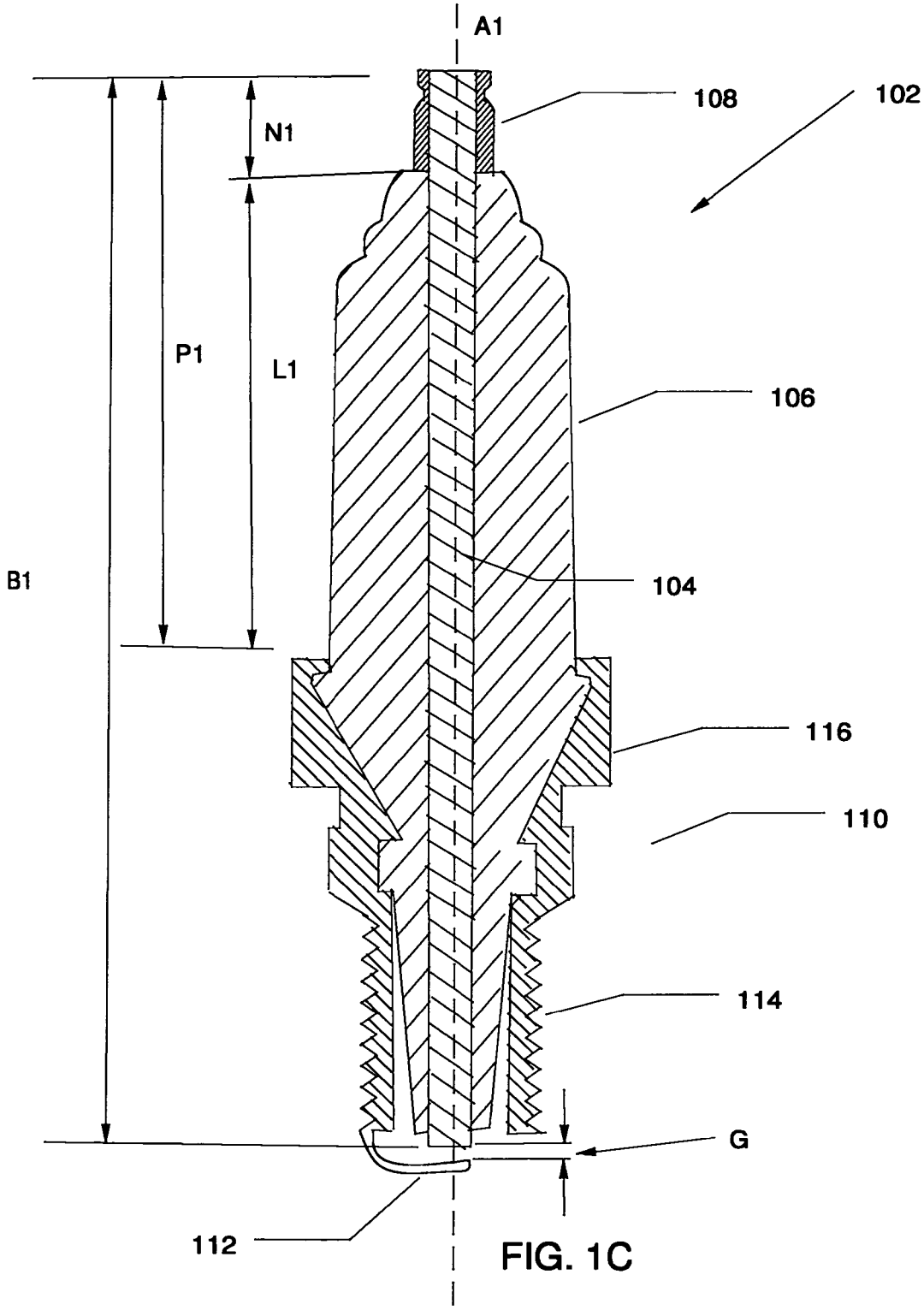
FIG. 1C Prior Art
FIG. 1C is a sectional view of the first prior art spark plug.

FIG. 1A illustrates a perspective view of a first prior art spark plug 102. FIG. 1B illustrates an exploded view of first prior art spark plug 102. FIG. 1C is a sectional view of first prior art spark plug 102 along a central axis A1. Referring to FIGS. 1A, 1B, and 1C, first prior art spark plug 102 has a rod-like central electrode 104 of length B1, a hollow cylindrical ceramic insulator 106 encasing central electrode 104, a conductive terminal 108 having length N1 attached to central electrode 104 at the top end, a hollow cylindrical metal shell 110 partially encasing ceramic insulator 106, and an L-shaped ground electrode 112 attached to the bottom of metal shell 110. The spark plug components are disposed along a central axis A1.

Central electrode 104, having length B1, is composed of a highly conductive material such as copper. It transmits a high voltage received from the ignition system's ignition coil via ignition wires that attach to first prior art spark plug 102 at terminal 108 located at the terminal end of first prior art spark plug 102 and delivers the high voltage to the tip located at the lower end of central electrode 104. The high voltage causes a spark to jump across a gap G to ground electrode 112. The ignition system, ignition coil and ignition wires are not shown in the figures.

Ceramic insulator 106, is retained in metal shell 110, encases and supports central electrode 104, insulates central electrode 104 from metal shell 110, dissipates heat from first prior art spark plug 102 and provides mechanical strength to protect first prior art spark plug 102 from engine vibration. Ceramic insulator 106 protrudes from the upper end of metal shell 110 and from the lower end of metal shell 110. The portion of ceramic insulator 106 protruding above the metal shell 110 has length L1.

Metal shell 110 has a hollow cylindrical shape, except for hexagonal nut 116, and is made of a conductive metal material such as low carbon steel. It has a threaded portion 114 for installation in the engine block and has hexagonal nut 116 that accepts a wrench to allow first prior art spark plug 102 to be installed and removed from the engine block.

Figure 2A:
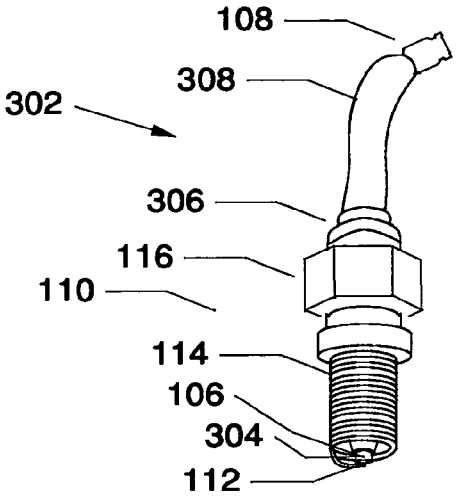
FIG. 2A is perspective view of the spark plug of a first embodiment.
Figure 2B:
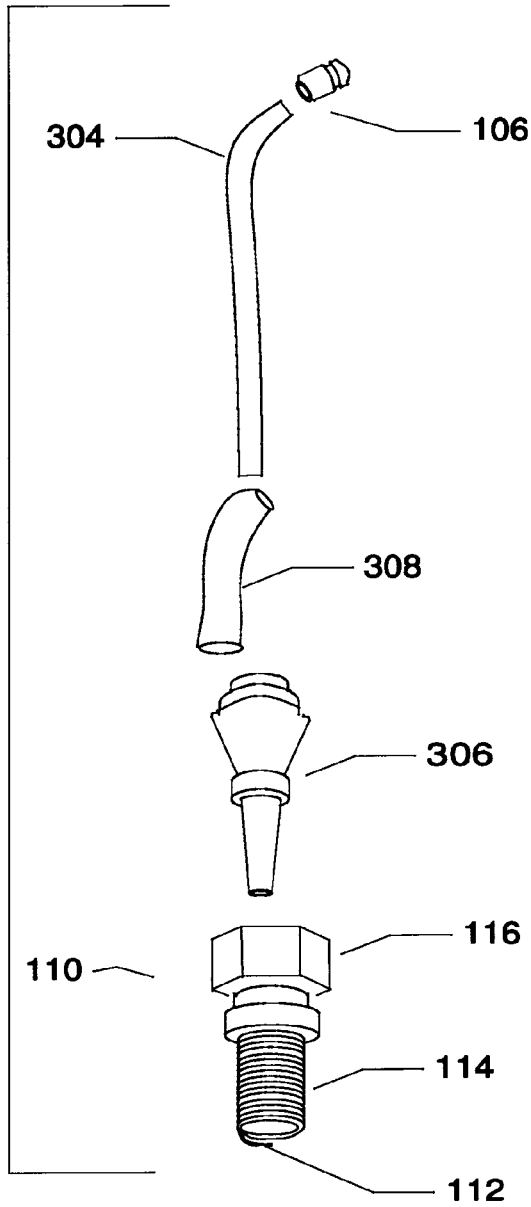
FIG. 2B is an exploded of the first embodiment of the present invention.
Figure 2C:
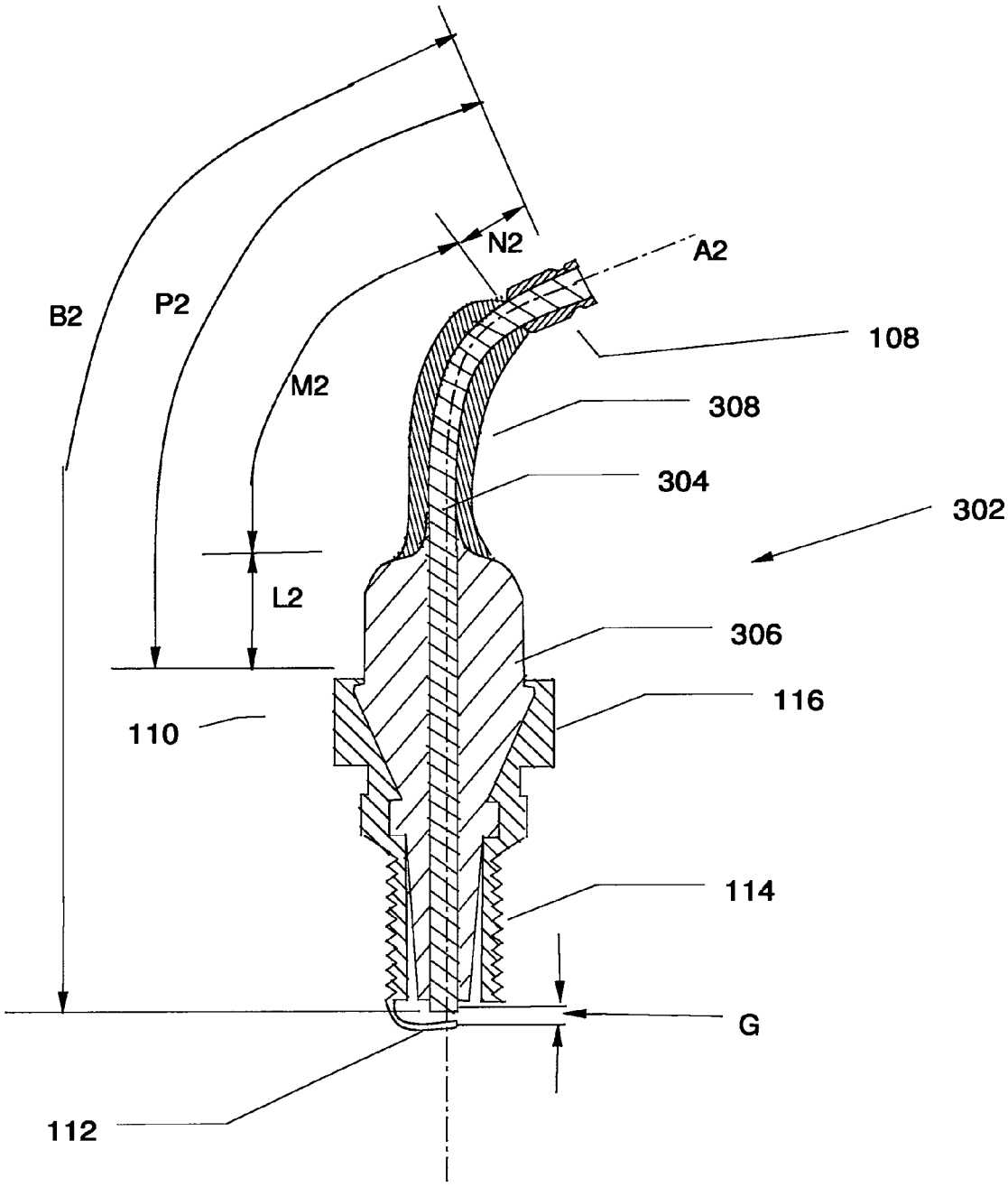
FIG. 2C is a sectional view of the first embodiment of the present invention.

FIGS. 2A, 2B, and 2C display a first embodiment 302 of the present invention, a first flexible spark plug 302. Referring to FIGS. 2A, 2B, and 2C, central electrode 104 of first prior art spark plug 102 is replaced by a flexible wire 304 of the same diameter as central electrode 104. It has length B2 approximately equal to the length B1 of the first prior art central electrode. As an example, if the central electrode 104 of first prior art spark plug 102 is a 10 gauge rigid copper rod, central electrode 304 of first embodiment 302 of the present invention is a 10 gauge flexible copper wire.

Ceramic insulator 106 of first prior art spark plug 102 is replaced by a shorter ceramic insulator 306 of a different shape than ceramic insulator 106 of first prior art spark plug 102. Specifically, the portion of ceramic insulator 306 above metal shell 110 of first embodiment 302 has length L2 that is considerably shorter than length L1 of ceramic insulator 104 above metal shell 110 of first prior art spark plug 102.

Referring now to FIGS. 1C and 2C, the portion of flexible wire central electrode 304 between the top of ceramic insulator 306 and the bottom of terminal 108 has length M2 and is covered by a flexible insulating material 308 such as a spark plug ignition wire cover. The total length of the portion spark plug 302 of first embodiment 102 above metal shell 110 has length P2=L2+M2+N2 that is the same length P1=L1+N1 of the portion spark plug 102 of first prior art spark plug 102 above metal shell 110. The remaining components and structure of the first embodiment spark plug 302 are the same as first prior art spark plug 102.

Spark plugs in use on many modern vehicles have significant improvements as compared to the first prior art spark plug 102. A second embodiment 702 of the present invention is presented herein that illustrates how the present invention may be adapted to a second prior art spark plug design. A second prior art spark plug 502 design is given here as an example for illustrative purposes only. The design can be adapted from the implementation of the second flexible spark plug 702 presented herein to other modern spark plug designs.

Figure 3A:
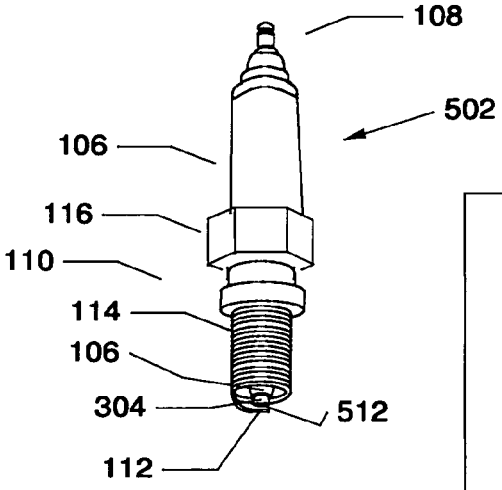
FIG. 3A PRIOR ART
FIG. 3A is a perspective view of a second prior art spark plug
Figure 3B:
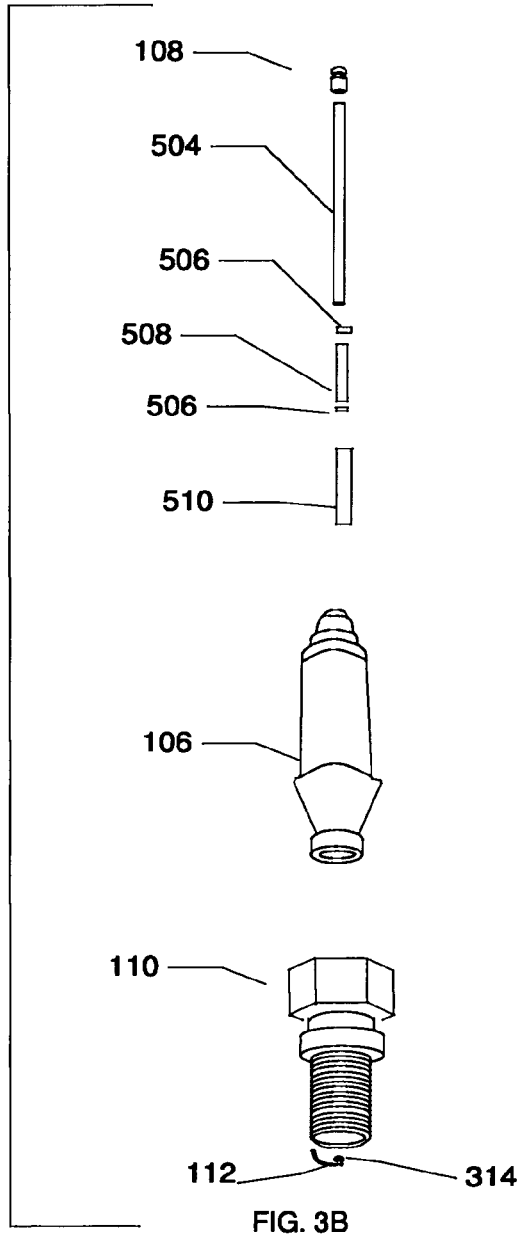
FIG. 3B PRIOR ART
FIG. 3B is an exploded view of the second prior art spark plug.
Figure 3C:
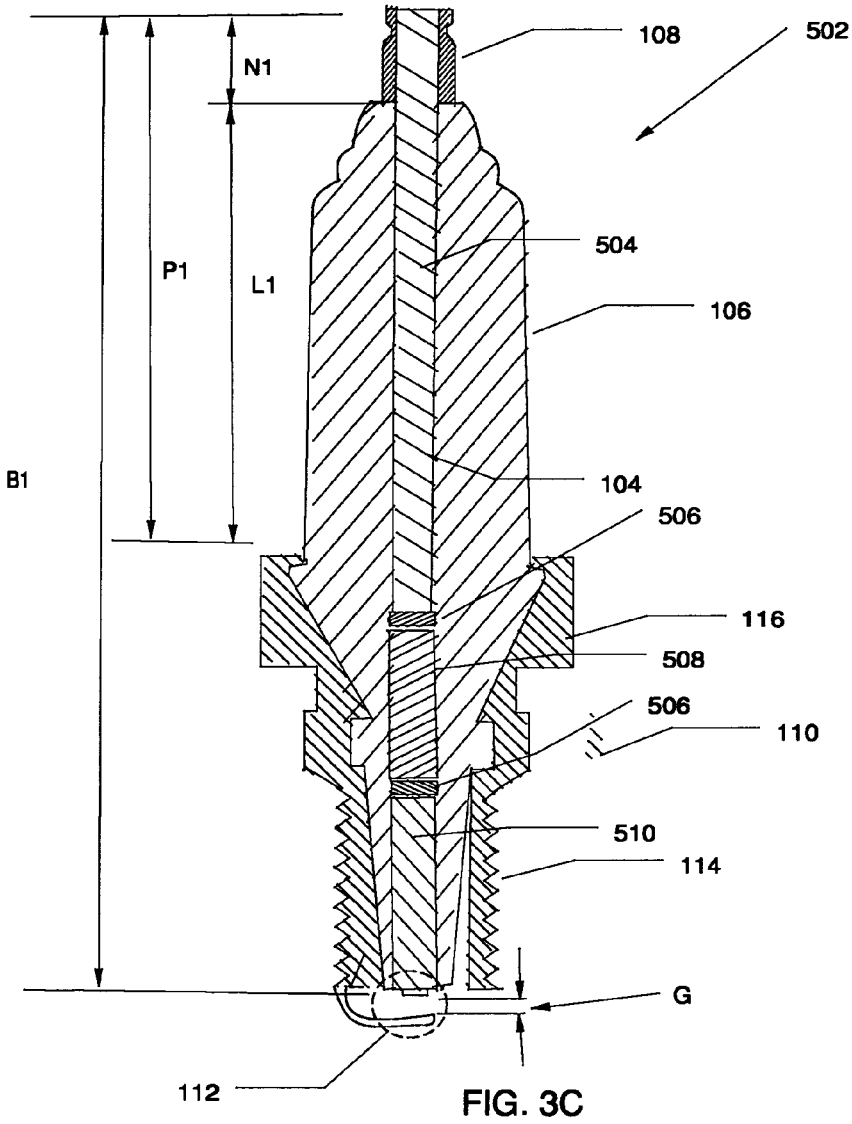
FIG. 3C Prior Art
FIG. 3C is a sectional view of the second prior art spark plug.
Figure 3D:
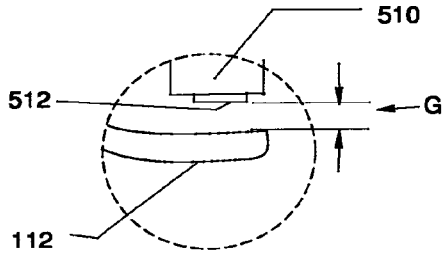
FIG. 3D is an expanded sectional view of a portion the second prior art spark plug.
Figure 4A:
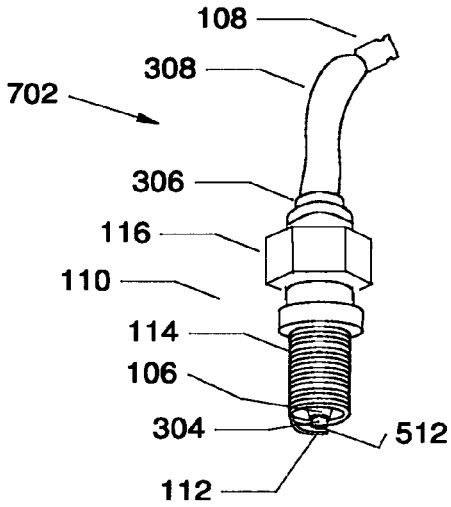
FIG. 4A is perspective view of a second embodiment of the current invention.
Figure 4B:
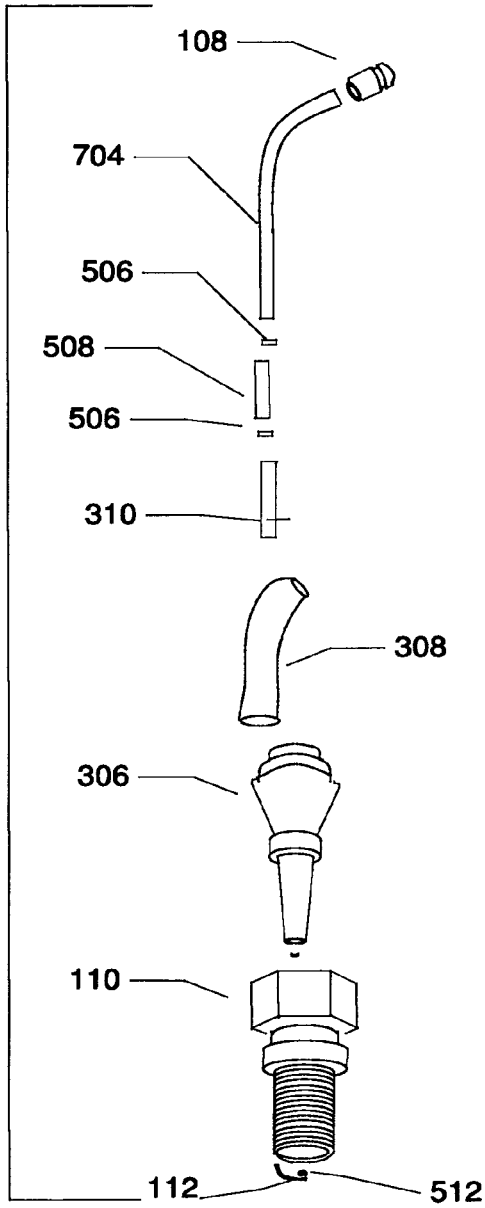
FIG. 4B is an exploded of the second embodiment of the current invention.
Figure 4C:
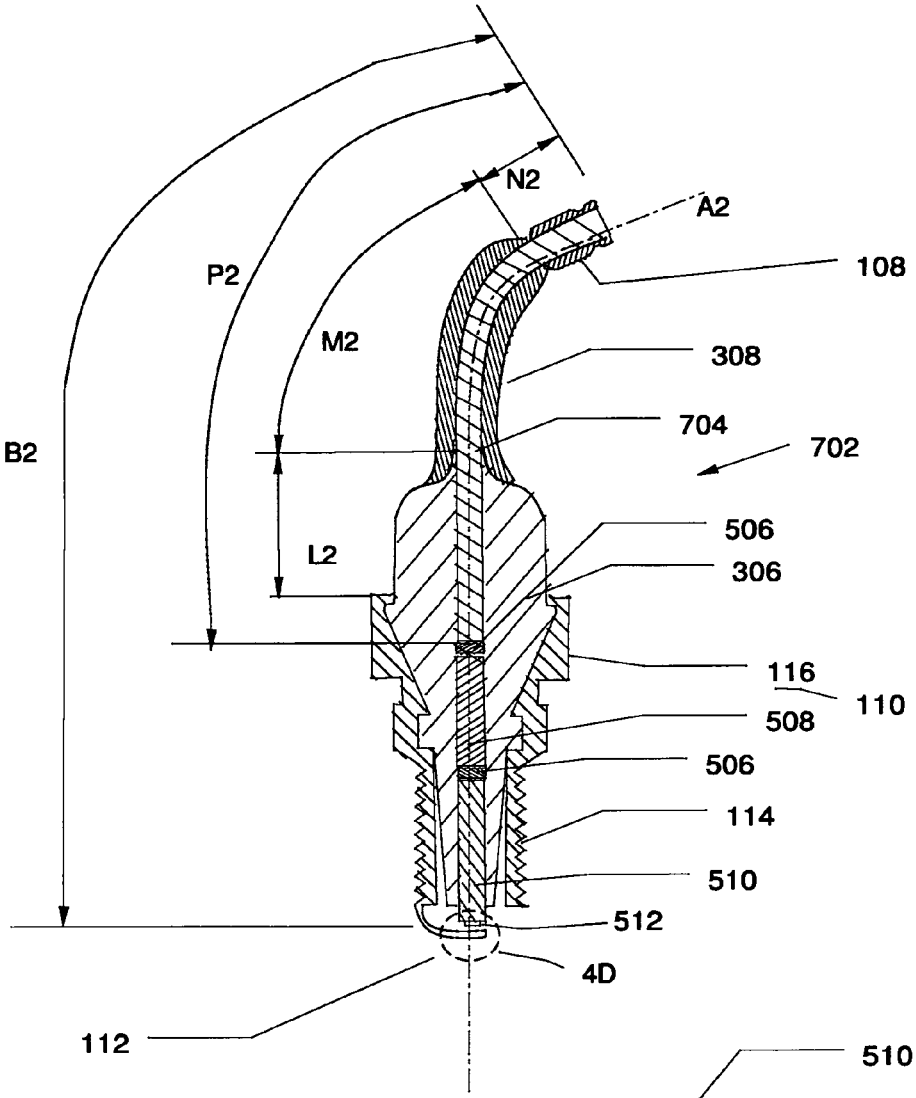
FIG. 4C is a sectional view of the second embodiment of the current invention.
Figure 4D:
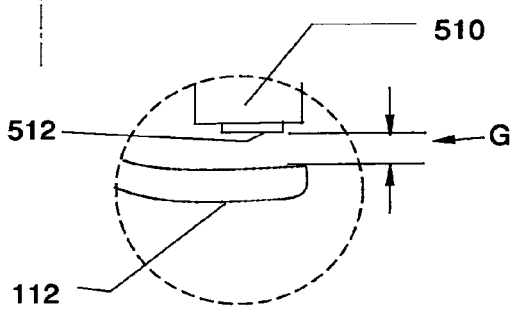
FIG. 4D is an expanded sectional view of a portion of the second embodiment of the current invention.

FIGS. 3A, 3B, 3C, and 3D illustrate the details of second prior art spark plug 502. FIG. 3A is a perspective view of second spark plug 502. FIG. 3B gives an exploded of second prior art spark plug 502 and FIG. 3C gives a sectional view of second prior art spark plug 502. FIG. 3D gives an exploded view of a portion of FIG. 3C.

Referring to FIGS. 3A through 3D, first prior art spark plug 102 has single rod central electrode 104 that runs the full length of spark plug 302 with length B1. Second prior art spark plug 502 replaces single rod central electrode 104 by several electrode components disposed along central axis A2: a top central electrode 504, a resistor 508, two glass seals 506, a lower central electrode 510 and a central electrode tip 512.

Referring now to FIG. 3C, top central electrode 504 of second prior art spark plug 502 is made of a single copper rod. Resistor 508 is made of a carbon-based material; two glass seals 506 are made from a copper glass material. Lower central electrode 510 is made from a highly heat conductive metal material such as Cu as the core material and a highly heat-resistant, corrosion-resistant metal material such as Ni (Nickel)-based alloy as the clad material. Tip 512, made from a precious-metal alloy, welded to central electrode 510, improves spark creation and reduces wear.

FIGS. 4A, 4B, 4C, and 4D illustrate a second embodiment 702 of the current invention: a second flexible spark plug 702. Second flexible spark plug 702 is a modification of second prior art spark plug 502. Most of the new components of second flexible spark plug 702, viz. resistor 508, two glass seals 506, lower electrode 510 and lower electrode tip 512 are the same as in second prior art spark plug 502 as illustrated in FIG. 3C.

The changes made in second flexible spark plug 702 as compared to second prior art spark plug 502 are as follow. Referring to FIGS. 3A, 3B, 3C, 4A 4B, and 4C, top central electrode 504 of second prior art spark plug 502 is replaced by a flexible wire 704 of the same diameter and length as top central electrode 504. Ceramic insulator 106 of second prior art spark plug 502 is replaced by shorter ceramic insulator 306 and flexible wire cover 308.

Referring to FIGS. 3A, 3B, 3C, 4A 4B, and 4C, only wire central electrode 504, ceramic insulator 106 needs to be replaced by flexible wire 704 , ceramic insulator 306 an flexible insulator 308 to convert second prior art spark plug 502 into second flexible spark plug 702. The remaining components of s second flexible spark plug 702 are incorporated without change to second prior art spark 502 design as shown in FIG. 3C.

The spark plug presented in the first and second embodiments are used is the same situations where the prior art spark plugs are used. However, the flexible nature of the central electrode design allows the invention embodiments to be used is tight situations where the flexible electrode may be bent to a convenient position. This is not possible with the prior art designs.

In the two embodiments presented herein, the overall length of each embodiment is set to the same length as the prior art spark plug they are based on. Modification of the length of the two embodiments may easily be made by changing the length of the flexible central electrode and adjusting the size of the flexible insulator accordingly.

The disclosure presented herein gives two embodiments of the invention. These embodiments are to be considered as only illustrative of the invention and not a limitation of the scope of the invention. Various permutations, combinations, variations, and extensions of these embodiments are considered to fall within the scope of this invention.

What is claimed is:

1. A spark plug comprising:

a flexible central electrode, the flexible central electrode having a terminal end;

a cylindrical ceramic insulator partially encasing the flexible central electrode;

a conductive terminal attached to the central electrode at the terminal end;

a flexible insulator wherein the central electrode is encased by the flexible insulator between the conductive terminal and the ceramic insulator.

2. The spark plug of claim 1 wherein the flexible central electrode is a flexible copper wire.

3. The spark plug of claim 1 wherein the portion of the flexible insulator between the conductive terminal and the ceramic insulator has an axial length of at least 2.54 cm.

4. The spark plug of claim 1 wherein the spark plug is dimensioned to so it is compatible with the usage of at least one existing commercially available spark plug.

5. A spark plug having a flexible central electrode with a terminal end, a ceramic insulator partially encasing the central electrode, wherein the central electrode is encased by a flexible insulator between the terminal end and the ceramic insulator.

* * * * *